US006032951A

United States Patent [19]

Yamaguchi

[11] Patent Number: 6,032,951

[45] Date of Patent: Mar. 7, 2000

[54] SHEET FEED/DISCHARGE ROLLER MECHANISM

[75] Inventor: Kazuhiko Yamaguchi, Nagano, Japan

[73] Assignee: Seiko Epson Corporation, Tokyo, Japan

[21] Appl. No.: 09/008,232

[22] Filed: Mar. 15, 1999

[30] Foreign Application Priority Data

Jan. 17, 1997 [JP] Japan ..... 9-020002

[51] Int. Cl.[7] ..... B65H 5/02

[52] U.S. Cl. ..... 271/274; 271/314

[58] Field of Search ..... 271/274, 273, 271/272, 275, 314

[56] References Cited

U.S. PATENT DOCUMENTS 4,522,520 6/1985 Takenoya et al. ..... 271/274 X

FOREIGN PATENT DOCUMENTS 62 285 841 12/1987 European Pat. Off. .
0 368 255 5/1990 European Pat. Off. .
0 545 178 6/1993 European Pat. Off. .
59 207 342 11/1984 Japan .
61 028 652 1/1986 Japan .
472246 3/1992 Japan ..... 271/274

*Primary Examiner*—David H. Bollinger
*Attorney, Agent, or Firm*—Stroock & Stroock & Lavan LLP

[57] ABSTRACT

A sheet feed/discharge roller mechanism that includes a plurality of driving rollers and a driven roller shaft disposed in the roller mechanism that is freely displaceable to the driving rollers. A plurality of driven rollers are mounted on the driven roller shaft in facing relationship with the driving rollers. A plurality of roller supporting members apply forces to the driven roller shaft for biasing the driven rollers towards the driving rollers. The forces applied to at least one of the driven rollers is greater than the forces applied to at least a second driven roller.

6 Claims, 2 Drawing Sheets

SHEET FEED/DISCHARGE ROLLER MECHANISM

BACKGROUND OF INVENTION

The present invention relates to a sheet feed/discharge roller mechanism utilized in a printer, a photocopier or similar equipment.

A paper conveyance roller mechanism used in printers or photocopiers is generally placed on either the paper feed side or the paper discharge side of the unit and includes driving rollers and driven rollers, which revolve as a result of being in contact with the driving rollers. Generally, driven rollers are placed in contact with driving rollers by using one of two approaches. In the first approach, the driven rollers are mounted on a common shaft and biased towards the driving rollers by a common spring that acts on the common shaft. In the second approach, each of the driven rollers are individually biased towards a respective driving roller by a separate respective spring without the benefit of a common shaft.

However, both of the above-described roller mechanisms have difficulty conveying a narrow and thick recording sheet, such as a post card. When a narrow and thick recording sheet is inserted into the roller mechanism where the driven rollers are all connected to a common shaft and pushed by a common spring, the biasing force, which is set to bias all rollers for a full paper sheet, is excessive for the thicker post card. As a result, depression marks may form on the portion of the recording sheet (post card) if it is depressed excessively by an edge of an inner roller of the roller mechanism. Also, the recording sheet may not be conveyed evenly because of the unbalanced conveyance force generated by such a roller mechanism. When a narrow and thick recording sheet, such as a post card, is inserted into the second type of roller mechanism, the recording sheet may not be conveyed evenly because of a disparity of contact positions between the individual driven rollers and the recording sheet. Accordingly, it is desired to provide a biasing system which can provide even feeding, without depression marks for both wide thin recording sheets (paper) and narrow thick recording sheets (post cards).

SUMMARY OF THE INVENTION

The present invention is for an improved sheet feed/discharge roller mechanism that correctly conveys recording sheets of varying sheet width and thickness. In accordance with the present invention, the roller mechanism includes a plurality of driving rollers and a driven roller shaft disposed in the roller mechanism that is freely displaceable relative to the driving rollers. A plurality of driven rollers are mounted on the driven roller shaft in facing relationship with the driving rollers. The driven roller shaft is supported by a plurality of roller supporting members which bias a respective driven roller towards a respective driving roller. The forces applied to at least a first driven roller being greater than the forces applied to at least a second driven roller so that when a narrow and thick recording sheet is inserted into the roller mechanism, the at least first driven roller applies a strong and uniform force to the recording sheet and correctly conveys the recording sheet.

Accordingly, it is an object of the invention to provide a sheet feed/discharge mechanism which correctly conveys a recording sheet with uniform depressing forces regardless of the sheet width and thickness.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
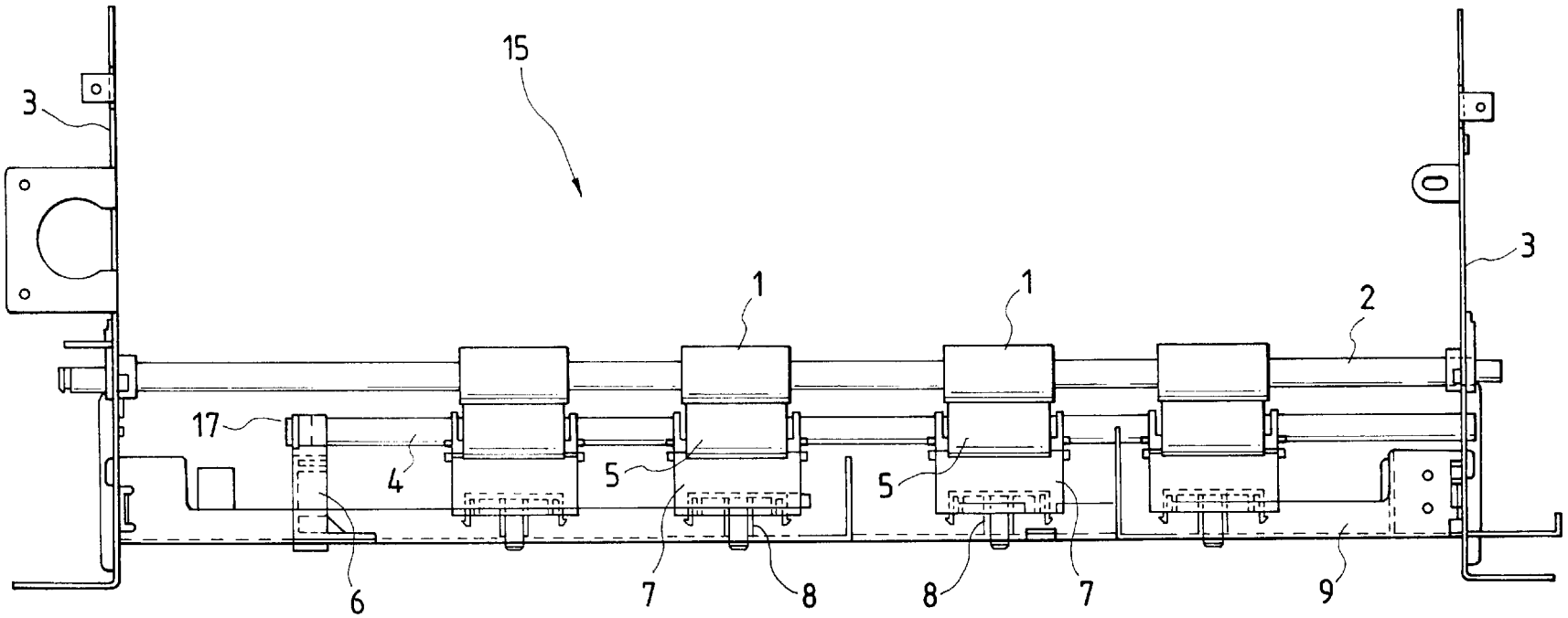
FIG. 1 is a front view of a sheet feed roller constructed in accordance with the present invention.
Figure 2:
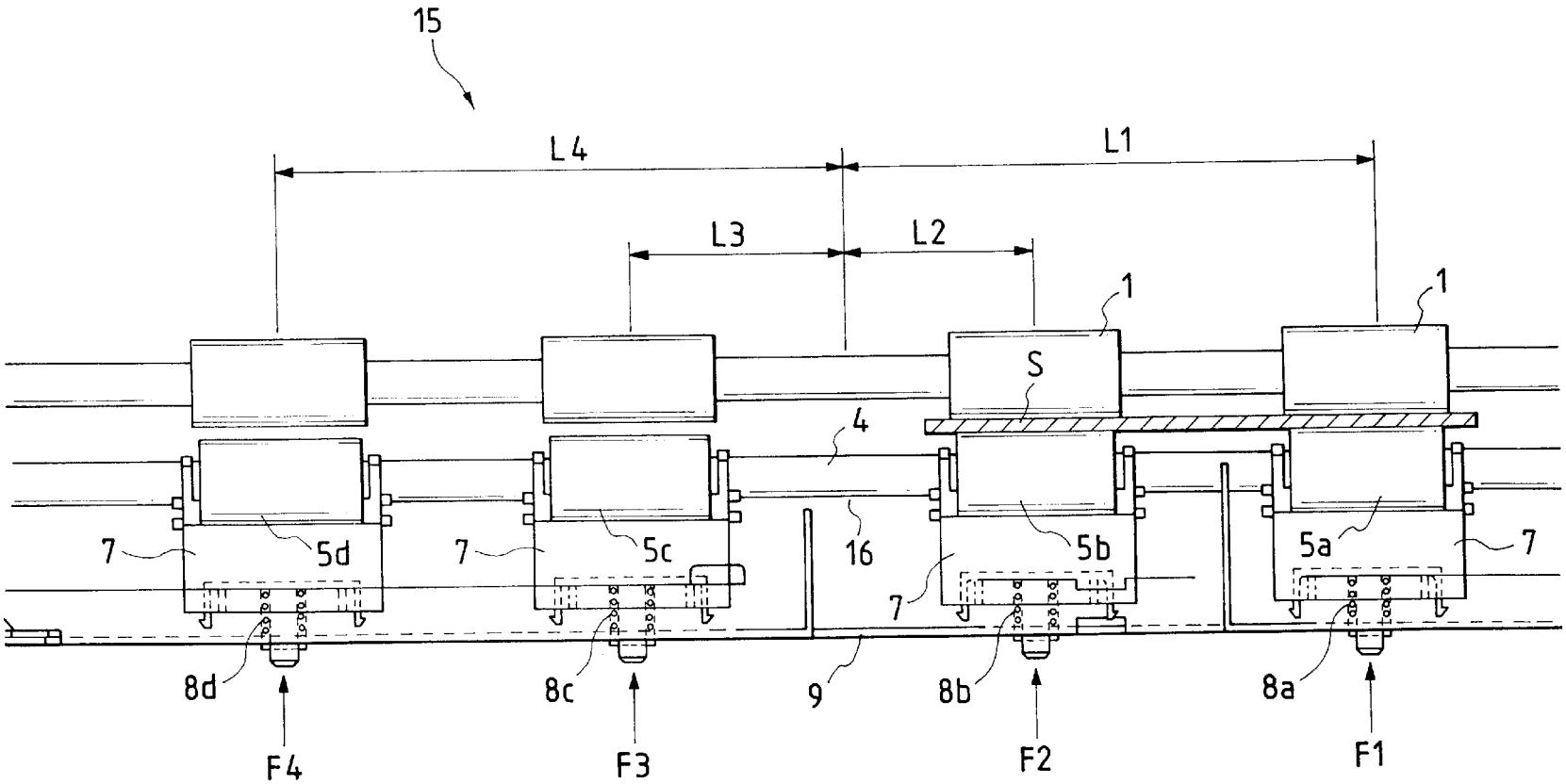
FIG. 2 is the sheet feed roller of FIG. 1 showing the applied forces acting on the driven rollers.

Referring now to FIGS. 1–2, there is shown a roller mechanism 15 constructed in accordance with the present invention. Mechanism 15 includes a pair of side frames 3. A driving roller shaft 2 is axially supported by side frames 3 with one side frame 3 placed on the right side of roller mechanism 15 and the other side frame 3 placed on the left of roller mechanism 15.

A driven roller shaft 4, having a plurality of driven rollers 5 mounted thereon, is attached to side frame 3 at one end and the other end of driven roller shaft 4 is attached to a bearing hat 17 that is provided in a bracket 6 so as to render driven roller shaft 4 freely displaceable in the vertical direction. A plurality of driving rollers 1 are mounted on driving roller shaft 2 so that driven rollers 5 revolve in unison. Driven roller shaft 4 is supported by a plurality of roller supporting members 7. One of a plurality of springs 8*a*–8*d* (collectively designated as 8) are inserted between each roller supporting member 7 and an auxiliary frame 9 thereby causing roller supporting members 7 to push driven roller shaft 4 which pushes each driven roller 5 towards its corresponding driving roller 1. Each driving roller 1 is biased to be in contact with corresponding driven roller 5.

Springs 8 are selected to apply a plurality of different forces F so that a uniform force is applied across the entire surface of a narrow and thick recording sheet S. Accordingly, forces F1 and F2, applied by springs 8*a* and 8*b* on roller supporting members 7*a* and 7*b* and which apply force on recording sheet S through driven rollers 5*a* and 5*b*, corresponding to the narrow thick recording sheet, are selected to be larger than each of forces F3 and F4 applied by springs 8*c* and 8*d*. In a preferred embodiment, the relationship between forces F1 and F2 and forces F3 and F4 is such that:

F1, F2>F3, F4 (i.e., F1>F3, F2>F3, F1>F4, and F2>F4). For example, forces F1 and F2 can be selected to be approximately 200 gf while forces F3 and F4 are specified to be approximately 150 gf.

In a preferred embodiment, the distance between respective driven roller 5 disposed on shaft 4 and the longitudinal center 16 of shaft 4 is L, L1 being the distance to roller 5*a*; L2 being the distance to driven roller 5*b*; L3 being the distance to driven roller 5*c*; and L4 being the distance to driven roller 5*d*. Distances L1 through L4 are selected so that $$L1F1+L2F2=L3F3+L4F4$$

where F1>F3

By selecting forces F1 through F4 and distances L1 through L4 in this manner, the total force applied to shaft 4 by springs 8*a* and 8*b* will be substantially equal to the total force applied to shaft 4 by springs 8*c* and 8*d*.

When narrow and thick recording sheet S (FIG. 2) is fed into roller mechanism 15, driven rollers 5*a* and 5*b* apply an approximately uniform force across the entire surface of recording sheet S so that recording sheet S is evenly conveyed through roller mechanism 15 and does not suffer depression marks. At the same time, driven rollers 5*c* and 5*d* are not in contact with driving roller 1.

When a wide recording sheet (not shown) is fed into roller mechanism 15, a uniform force is also applied across the entire width of the wide recording sheet. Because the total force applied to shaft 4 by springs 8*a* and 8*b* equals the total force applied by springs 8*c* and 8*d* to shaft 4, shaft 4 will remain substantially parallel to auxiliary frame 9. As a result, the force applied to a wide recording sheet by rollers 5*a* through 5*d* will be substantially uniform across the entire sheet.

Therefore, in the present invention, because driven roller shaft 4, which includes and supports driven rollers 5 that are in facing relationship with driving rollers 1, is disposed in roller mechanism 15 so as to be freely displaceable in the vertical direction, and driven rollers 5*a* and 5*b*, that are designated to convey narrow recording sheets, have forces applied to them that are larger than the forces which are applied to driven rollers 5*c* and 5*d*, narrow width recording sheets are evenly conveyed by driven rollers 5*a* and 5*b* without suffering from depression marks.

Additionally, recording sheets of various widths are also correctly conveyed by appropriately selecting forces F applied to each driven roller 5 according to distances L of each driven rollers 5 from longitudinal center 16 of driven roller shaft 4. Also, because each driven roller 5 is placed at predetermined distances L1 to L4 from longitudinal center 16 of shaft 4, driven rollers 5 apply a uniform force across the wide recording sheet so that a wide recording sheet is correctly conveyed through roller mechanism 15.

It will thus be seen that the objects set forth above, and those made apparent from the preceding description, are efficiently attained and, since certain changes may be made in the above constructions without departing from the spirit and scope of the invention, it is intended that all after conaed m the above ad option or shown in the accompanying drawings shall be interpreted as illustrative and not in a limiting sense.

I claim:

1. A sheet feed/discharge roller mechanism comprising:

a side frame;

a bracket;

a plurality of driving rollers;

a driven roller shaft disposed between said side frame and said bracket and freely displaceable towards said driving rollers;

a plurality of driven rollers mounted on said driven roller shaft in facing relationship with said driving rollers, and a plurality of roller supporting members said roller supporting members each including a spring, said springs applying a plurality of different forces to said driven roller shaft for biasing said driven rollers towards said driving rollers, said forces applied to at least one of said driven rollers being greater than said forces applied to at least a second driven roller.

2. A sheet feed/discharge roller mechanism comprising:

a side feed frame;

a bracket;

a plurality of driving rollers;

a driven roller shaft disposed between said side frame and said bracket and freely displaceable towards said driving rollers;

a plurality of driven rollers mounted on said driven roller shaft in facing relationship with said driving rollers, and a plurality of roller supporting members said roller supporting members each including a spring, said springs applying a plurality of different forces to said driven roller shaft for biasing said driven rollers towards said driving rollers, said forces applied to at least one of said driven rollers being greater than said forces applied to at least a second driven roller, said driven roller shaft having a longitudinal center, each of said driven rollers being separated from said longitudinal center by a distance, the plurality of driven rollers being divided into a first group and a second group and the sum of the products of said forces applied to said driven rollers and said distances from said longitudinal center for each of said driven rollers in said first group, respectively, is substantially equal to the sum of the products of said forces applied to said driven rollers and said distances from said longitudinal center for each of said driven rollers in said second group, respectively.

3. The sheet feed/discharge roller mechanism of claim 2 wherein a force F1 biases a first driven roller towards said driving rollers, a force F2 biases a second driven roller towards said driving rollers, a force F3 biases a third driven roller towards said driving rollers, a force F4 biases a fourth driven roller towards said driving rollers, and F1, F2, F3, and F4 being selected so that F1>F3 or F4 and F2>F3 or F4.

4. The sheet feed/discharge roller mechanism of claim 3 wherein the first driven roller is a distance L1 from said longitudinal center, the second driven roller is a distance L2 from said longitudinal center, the third driven roller is a distance L3 from said longitudinal center, the fourth driven roller is a distance L4 from said longitudinal center, and L1, L2, L3 and L4 being selected so that L1F1+L2F2=L3R3+L4F4 where F1>F3.

5. A method for evenly conveying a recording sheet through a sheet feed/discharge roller mechanism that includes a plurality of driving rollers comprising the steps of:

placing a driven roller shaft in said mechanism so as to be freely displaceable towards said driving rollers;

mounting a plurality of driven rollers on said driven roller shaft in facing relationship with said driving rollers, supporting said driven roller shaft with a plurality of roller supporting members, said roller supporting members applying a plurality of different forces to said driven roller shaft; and biasing said driven rollers towards said driving rollers with a force applied to at least one of said driven rollers being greater than said force applied to at least a second driver roller.

6. The method of claim 5 further comprising the steps of:

identifying a longitudinal center of said driven roller shaft, dividing said plurality of driven rollers into a first group and a second group, and separating each of said driven rollers from said longitudinal center by a distance so that the sum of the products of said forces applied to said driven rollers and said distances from said longitudinal center for each of said driven rollers in said first group, respectively, is substantially equal to the sum of the products of said forces applied to said driven rollers and said distances from said longitudinal center for each of said driven rollers in said second group, respectively.

* * * * *

UNITED STATES PATENT AND TRADEMARK OFFICE

CERTIFICATE OF CORRECTION

PATENT NO. : 6,032,951

DATED : March 7, 2000

INVENTOR(S) : Kazuhiko Yamaguchi

It is certified that error appears in the above-indentified patent and that said Letters Patent is hereby corrected as shown below:

ON THE TITLE PAGE

At Number [22], please delete "March 15, 1999" and insert --January 16, 1998- -

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*